United States Patent [19]

Sjönell

[11] Patent Number: 4,509,861

[45] Date of Patent: Apr. 9, 1985

[54] METHOD OF MIXING ONE SUBSTANCE WITH ANOTHER SUBSTANCE

[76] Inventor: Göran Sjönell, 11 Askrikevägen, S-181 46 Lidingö, Sweden

[21] Appl. No.: 461,547

[22] Filed: Jan. 27, 1983

[51] Int. Cl.[3] ..... B01F 3/12; B01F 15/02

[52] U.S. Cl. ..... 366/131; 141/27; 366/130; 366/161; 366/167; 366/191; 366/348; 604/56; 604/92; 604/183

[58] Field of Search ..... 366/131, 163, 167, 183, 366/191, 341, 348, 349, 136, 137, 139, 159, 130, 161; 604/7, 56, 82, 84, 85, 92, 183; 141/27, 67, 258; 222/129.2, 129.3, 129.4, 144.5

[56] References Cited

U.S. PATENT DOCUMENTS

| | | | |
|---|---|---|---|
| 2,432,004 | 12/1947 | Gray | 222/318 |
| 2,842,124 | 7/1958 | James | 604/7 |
| 3,190,619 | 6/1965 | Penney et al. | 604/82 |
| 3,223,485 | 12/1965 | Ferrari et al. | 366/183 |
| 3,385,480 | 5/1968 | Tidwell | 222/318 |
| 3,561,733 | 2/1971 | Formeck | 366/163 |
| 3,572,338 | 3/1971 | Murray, Jr. | 604/85 |
| 4,235,552 | 11/1980 | Underwood | 366/137 |
| 4,237,880 | 12/1980 | Genese | 222/129.2 |
| 4,253,501 | 3/1981 | Ogle | 141/27 |
| 4,253,942 | 3/1981 | Gaumann | 366/341 |
| 4,340,308 | 7/1982 | Tharp | 366/137 |
| 4,407,431 | 10/1983 | Mutter | 366/137 |

*Primary Examiner*—Philip R. Coe
*Attorney, Agent, or Firm*—Sherman & Shalloway

[57] ABSTRACT

The invention refers to a method of mixing, for example, cytostatica stored in an ampule (1) provided with a rubber closure (8) or corresponding closure, with, for example, sterile water stored in a second ampule (2) provided with a rubber closure (12) or corresponding closure. The invention is characterized in that a first tube (7) of hypodermic needle shape, which is connected by a hose connection (6) to a first port (5) of a multi-way valve (4), is pierced through the rubber closure (8) of one ampule (1), that a second tube (11) of hypodermic needle shape, which is connected by a hose connection (10) to a second port (9) of the multi-way valve (4), is pierced through the rubber closure (12) of said second ampule (2). The interior of the ampules is interconnected by a hose connection (13), the two respective ends of which have the shape of hypodermic needles (14,15) and are pierced each through one rubber closure (8,12). A pump means in the form of a self-expanding bellows (23) or hypodermic syringe (17) is connected to a third port (16) of the multi-way valve (4). By said pump means (17,23) and alternating adjustment of the multi-way valve (4), the substance in one ampule (2) is transferred to the second ampule (1), in which the two substances are mixed with each other, and the mixture is sucked into the pump means (17,23).

9 Claims, 3 Drawing Figures

METHOD OF MIXING ONE SUBSTANCE WITH ANOTHER SUBSTANCE

This invention relates to a method of mixing one substance, for example cytostatica, with another substance, for example sterile water. These substances, which are used in medical care, are transported and stored in ampules, which are sealingly closed with a rubber cover or membrane.

Cytostatica are used in medical care for the treatment of patients suffering from cancer, either by intravenous injection or from a drop bottle. Cytostatica are delivered in powder state in an ampule of the aforesaid kind and must be mixed, prior to their administration, with a liquid, for example sterile water, alcohol, physical saline solution or some other solution. The liquid, too, is delivered in an ampule of the kind referred to above. At present, the two substances are intermixed in such a manner, that the liquid by means of the hypodermic syringe to be used for the injection is sucked from the ampule up into the syringe and is delivered to the dry ampule, viz. the ampule containing the cytostatica. In this ampule the cytostatica content is mixed with liquid to the desired concentration, and the mixture thereafter is sucked into the syringe. Prior to the injection, the syringe is emptied of air possibly included therein. This emptying normally is carried out in the established manner by holding the syringe in vertical position, with the hypodermic needle pointing upward, and pressing the plunger inward until liquid can be observed in the needle point.

It is easily understood that the afore-described method of intermixing the two substances implies great risks of spillage in the form of droplets and splash as well as of contamination of the surrounding air, due to the outflow of gas from the ampules.

Cytostatica a.o. have proved toxic and to negatively affect healthy persons. The personnel handling this substance are exposed to great risks of inhaling such cancerogenous substances or by direct contact to be infected with them. In order to reduce this risk, and also the risk involved with the handling of other toxic substances, claims have been raised that the preparatory handling of the substances and the filling, for example of hypodermic syringes, shall take place in evaporation hoods.

The present invention has the object to eliminate the risks of contaminating the surrounding and infecting the personnel, who handle these substances when they are mixing toxic substances e.g. of the aforesaid type for their subsequent use, for example injection.

Figure 2:
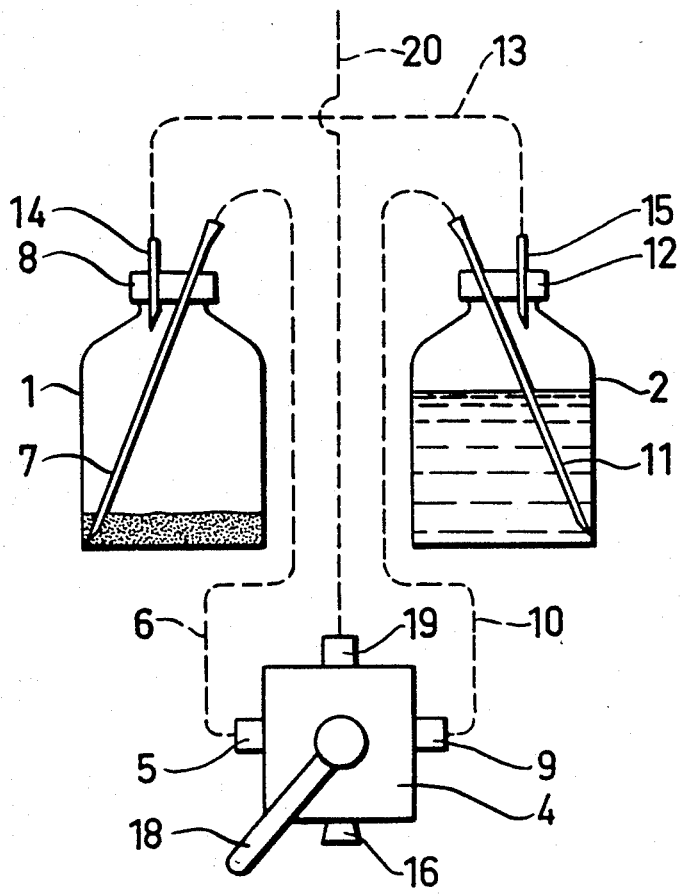
Figure 3:
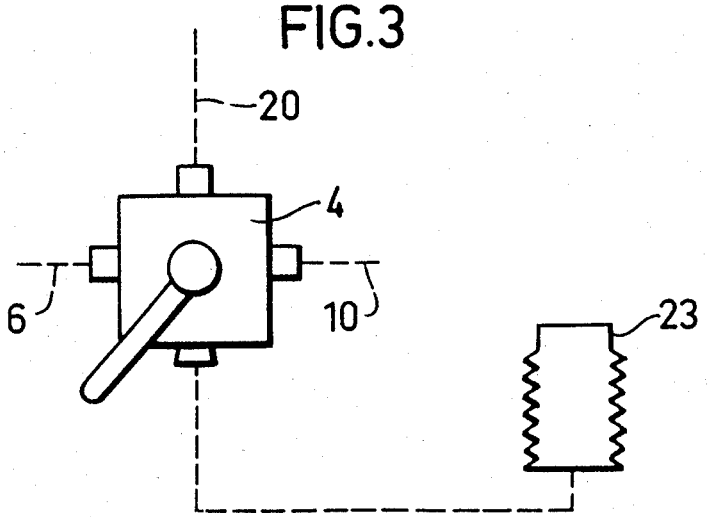

The invention is described in greater detail in the following, by way of an embodiment thereof and with reference to the accompanying drawings, in which FIG. 1 in a very schematic manner shows the equipment according to the invention for carrying out the method, FIG. 2 also in a very schematic manner shows the same equipment, but with the ampules seen in a lateral view, and FIG. 3 shows a slightly different equipment.

Figure 1:
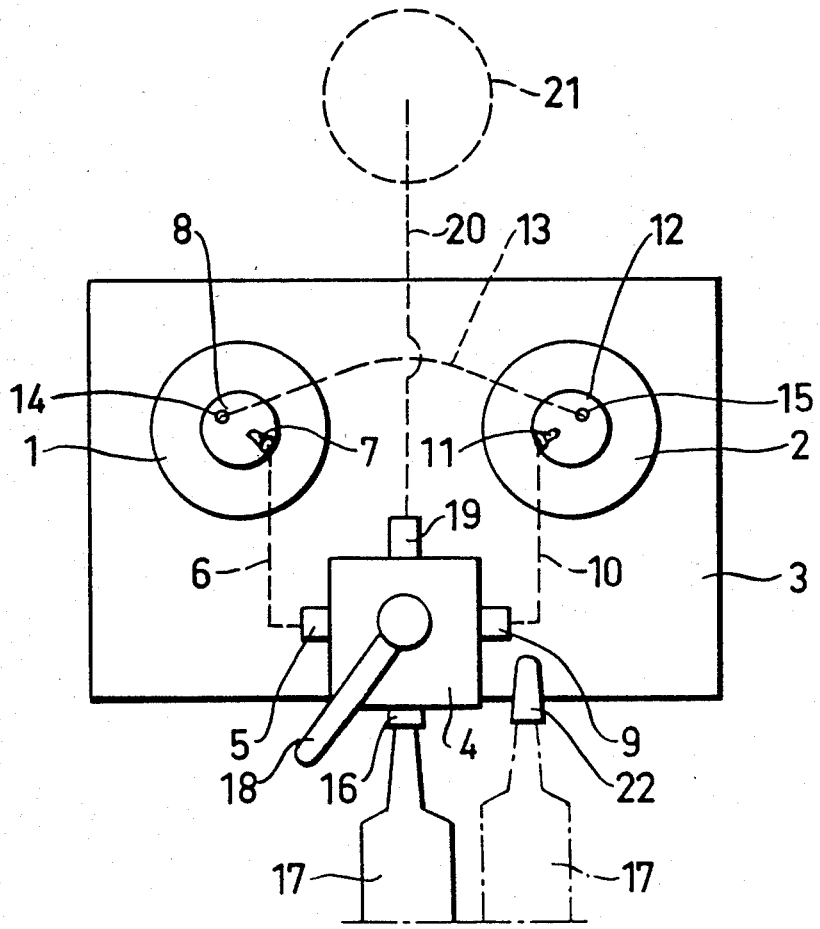

FIG. 1 shows two ampules 1 and 2 whereof one, for example 1, contains cytostatica, and the second ampule contains sterile water. These ampules are positioned by press fit in depressions provided, for example, in a frigolite plate and are fixed therein. On this frigolite plate 3 also a multi-way valve 4 is attached, for example by press fit, in a depression in the plate, or it is secured therein by glueing.

The multi-way valve 4 comprises four ports whereof a first one 5 is connected by a hose 6 to a hypodermic needle 7, which is pierced down into the ampule 1 through a rubber closure 8 sealing the ampule 1 hermetically. A second port 9 is connected via a hose 10 to the second ampule 2, in that a hypodermic needle 11 attached to the other end of the hose 10 is pierced down, in the same manner as the needle 7, into the ampule 2 through a rubber closure 12 sealing hermetically said ampule 2. A hose 13, is provided at each end with a needle 14 and, respectively, 15 similar to a hypodermic needle, interconnects the interior of the two ampules, in that the needles 14 and 15 are pierced through the rubber closures 8 and, respectively, 12. The hose 13 is provided to allow the equalization of pressures within the ampules 1 and 2 during the transfer of the liquid in ampule 2 to the ampule 1. The multi-way valve 4 further comprises a third port 16, into which the opening of a hypodermic syringe 17 can be sealingly introduced.

The method of mixing the cytostatic powder in the ampule 1 with the sterile water in ampule 2 is as follows: A certain amount of air is supplied into the system which is assembled of the hoses and ampules, through the hose 10 by means of the hypodermic syringe 17, which with its opening has been attached sealingly in the port 16. The amount of air is adjusted, for example, by adjusting the handle 18 on the multi-way valve. This air supply has the object to facilitate the subsequent sucking of water out of the ampule 2 via the hypodermic needle 11, hose 10, and port 9 into the syringe 17. The handle 18 now is adjusted so that the port 5 opens, while the ports 9 and 19 are closed, and the water is injected from the syringe into the ampule 1. The handle again is adjusted so that the port 9 opens (the ports 5 and 19 are closed), and a new batch of water is sucked into the syringe 17. The handle 18 is again adjusted so as to open the port 5, and said new batch is injected into the ampule 1. This procedure is repeated until all liquid has been transferred from the ampule 2 to the ampule 1. The resulting mixture in ampule 1 then can be sucked into the syringe 17.

At the embodiment shown, the multi-way valve 4 is provided with a fourth port 19, which by a hose 20 is connected directly to an infusion unit 21. The mixture contained in the syringe 17 can be supplied directly to the infusion unit 21 via the hose 20, in that the handle 18 is adjusted so that the ports 5 and 9 are closed and the port 10 opens. During this entire procedure no gas or liquid could penetrate out of the equipment, viz. syringe, hoses and ampules.

When the hypodermic syringe is to be used for injection, subsequent to the filling of the syringe the opening thereof preferably can be inserted into a sealing cap 22 (FIG. 1), which closes the opening and is attached in a suitable manner to the plate 3. When the syringe 17 is to be transported to its place of use, the sealing cap, which still is attached on the syringe 17, is broken off in a simple way from the plate 3. Neither during this entire procedure of syringe filling with the mixture there is any risk of liquid or gas penetrating out of the equipment described.

When the mixture has been transferred to the infusion unit 21, or the syringe 17 together with the sealing cap 22 has been removed from the plate 3, the entire equipment, i.e. ampules, plate, hoses and valve (if appropriate, with the syringe remaining thereon in the situation wherein the infusion unit 21 has been employed), is discarded.

In some cases it could be convenient to directly inject the liquid in the patient, in which case the infusion unit 21 is deleted and the hose 20 is provided with a cannula. The liquid is then injected by means of the syringe 17 or the bellows 23, described later on.

Instead of a hypodermic syringe 17, a pump means 23 can be used, which then is connected to the third port 16 of the multi-way valve 4. The pump means 23 in principle may consist of a self-expanding bellows, for example of plastic, which preferably is attached on the multi-way valve 4 or on the plate 3 in vertically upright position. The two substances here are mixed in the same way as in the case of the syringe 17 being used. The pump means, viz. the bellows 23, is compressed and thereafter at its expansion sucks up liquid in the ampule 2 via the hypodermic needle 11, hose 10 and port 9. Due to the adjusting of the handle 18 and the compression of the bellows, the liquid is transferred to the ampule 1, in which the mixing takes place. Thereafter the bellows is permitted to expand, whereby the mixture is sucked up into the ampule 1. This condition corresponds to the syringe 17 in filled state, with the difference, however, that the utilization of a bellows does not imply the risk which may arise at the utilization of a syringe, viz. that the syringe unintentionally may loosen from the multi-way valve 4 and thereby with its content contaminate the surrounding. When the system is equipped with a bellows, the hose 20, for example, can be provided with a connection (not shown), at which a hypodermic syringe to be used can be attached. The syringe then can be filled by sucking up with the same the mixture from the bellows.

It is not absolutely necessary to supply a certain amount of air to the system prior to the sucking of liquid into the syringe, but the liquid can be sucked directly into the syringe whereby a certain pressure balance in the system takes place in that air is sucked into the ampules in holes about the hypodermic needles.

As mentioned above, the invention has been described with reference to an embodiment thereof. The equipment used, of course, can be varied within the scope of the invention. The plate with hoses and valve and the sealing cap can be delivered in sets, with recesses for ampules of varying size. The hypodermic needles 7,11 and the needles 14,15, of course, may have a design other than that shown. Hypodermic needles in this connection are to be understood to be tubes pointed at one end and easy to penetrate through the rubber closures of the ampules.

I claim:

1. A method of mixing one substance stored in a first container provided with first closure means with a second substance stored in a second container provided with second closure means, the method comprising the steps of:

(a) communicating interior portions of said first container with a first port of a multi-way valve;

(b) communicating interior portions of said second container below the level of said second substance with a second port of said multi-way valve;

(c) connecting venting conduit means between said interior portions of said first and second containers through said first and second closure means;

(d) connecting pump means to a third port of said multi-way valve;

(e) adjusting said valve to connect said second and third ports and actuating said pump means to draw some of said second substance into said pump means;

(f) adjusting said valve to close the connection between said second and third ports and to connect said first and third ports and pumping said some of said second substance from said pump means into said first container in mixture with said first substance;

(g) repeating steps (e) and (f) until all of said second substance has been pumped into said first container and has been mixed with said first substance to form a mixture; and (h) with said valve adjusted to connect said first and third ports, sucking said mixture into said pump means.

2. A method as defined in claim 1, characterized in that a connection is connected to a fourth port of the multi-way valve, which connection can be connected to an infusion unit, whereby the mixture can be transferred directly via the pump means and multi-way valve to the infusion unit.

3. A method as defined in claim 1, characterized in that a connection is connected to a fourth port of the multi-way valve, which connection can be connected to a cannula, whereby the mixture can be transferred directly via the pump means and multi-way valve to the patient.

4. A method as defined in claim 1, 2 or 3, characterized in that the pump means receiving the mixture consists of a hypodermic syringe having an opening, which syringe may be moved from said third port to and with its opening inserted into a sealing cap attached to structure at the side of the third port, said cap closing said opening.

5. A method as defined in claim 4, characterized in that for transporting the syringe subsequent to its filling with the mixture, the sealing cap with the syringe opening inserted therein is removed from its attachment.

6. A method as defined in claim 1, characterized in that the pump means receiving the mixture is a self-expanding bellows, and the mixture is delivered therefrom via a fourth port of the multi-way valve.

7. The method of claim 1, wherein said first substance comprises cytostatica powder, and said second substance is a liquid.

8. The method of claim 7, wherein said liquid comprises sterile water.

9. A method of mixing one substance stored in a first container provided with first closure means with a second substance stored in a second container provided with second closure means, the method comprising the steps of:

(a) communicating interior portions of said first container with a first port of a multi-way valve;

(b) communicating interior portions of said second container below the level of said second substance with a second port of said multi-way valve;

(c) venting said interior portions of said first and second containers through said first and second closure means;

(d) connecting pump means to a third port of said multi-way valve;

(e) adjusting said valve to connect said second and third ports and actuating said pump means to draw some of said second substance into said pump means;

(f) adjusting said valve to close the connection between said second and third ports and to connect said first and third ports and pumping said some of said second substance from said pump means into said first container in mixture with said first substance;

(g) repeating steps (e) and (f) until all of said second substance has been pumped into said first container and has been mixed with said first substance to form a mixture; and (h) with said valve adjusted to connect said first and third ports, sucking said mixture into said pump means.

* * * * *

UNITED STATES PATENT AND TRADEMARK OFFICE

CERTIFICATE OF CORRECTION

PATENT NO. : 4,509,861

DATED : April 9, 1985

INVENTOR(S) : GORAN SJONELL

It is certified that error appears in the above-identified patent and that said Letters Patent is hereby corrected as shown below:

On the title page;

Please insert the following Foreign Application Priority Data:

--Swedish Application No. 8200504, filed January 29, 1982--.

Signed and Sealed this

*Twenty-third* Day of *July 1985*

[SEAL]

*Attest:*

DONALD J. QUIGG

*Attesting Officer*

*Acting Commissioner of Patents and Trademarks*